United States Patent [19]

Chiasson et al.

[11] 4,078,337

[45] Mar. 14, 1978

[54] APPARATUS FOR SHARPENING ICE SKATE BLADES AND THE LIKE

[76] Inventors: Robert H. Chiasson, 47 Lyman St.; Gerard J. Chiasson, 27 Warren Ave., both of Waltham, Mass. 02154

[21] Appl. No.: 757,991

[22] Filed: Jan. 10, 1977

[51] Int. Cl.[2] ..... B24B 9/04; B24B 21/10

[52] U.S. Cl. ..... 51/141; 51/228

[58] Field of Search ..... 51/135 R, 141, 148, 51/228; 76/83

[56] References Cited

U.S. PATENT DOCUMENTS

| | | | |
|---|---|---|---|
| 844,366 | 2/1907 | Kitson | 51/141 |
| 1,480,422 | 1/1924 | Strom | 51/228 |
| 1,820,377 | 8/1931 | Curtis | 51/141 |
| 1,844,165 | 2/1932 | Kabelac | 51/141 |
| 3,650,073 | 3/1972 | Weisman | 51/141 |
| 3,827,185 | 8/1974 | Smith | 51/228 |
| 3,972,152 | 8/1976 | Faure | 51/141 |

*Primary Examiner*—Harold D. Whitehead

*Assistant Examiner*—Nicholas P. Godici

*Attorney, Agent, or Firm*—Morse, Altman, Oates & Bello

[57] ABSTRACT

An apparatus using an abrasive belt is employed for sharpening ice skates quickly and accurately to any one of a variety of different hollow ground curvatures. The abrasive belt is mounted on pulleys and driven at a high speed across a changeable head which shapes the belt to the desired curvature for grinding a skate edge moved longitudinally thereagainst. The skate is mounted by means of a clamp so as to present the blade edge in a precise grinding position with respect to the belt and the head. The clamp is slidably mounted on the top of a carriage moveable along a guideway parallel to the head, whereby a blade edge may be brought to bear in a movement corresponding to the profile of the blade edge. The head may be changed to different positions in order to present different curvatures in the belt, depending upon the radius of curvature desired in a skate edge.

4 Claims, 8 Drawing Figures

APPARATUS FOR SHARPENING ICE SKATE BLADES AND THE LIKE

BACKGROUND OF THE INVENTION

1. Field of the Invention

This invention relates generally to machines for sharpening the blade edges of ice skates or the like, and more particularly is directed towards a new and improved apparatus for hollow grinding a skate blade edge to any one of a variety of different curvatures.

2. Description of the Prior Art

A conventional technique for sharpening ice skates is to use a standard grinding wheel and to move the blade edge across the face of the wheel. The skate is usually held with the blade in the same plane as the wheel so that the blade edge is tangential to the wheel. Using a wheel with a cylindrical peripheral surface, the blade will be ground flat. If it is desired to hollow grind the blade, as is commonly the case, it is necessary to first shape the periphery of the wheel to the desired radius using an appropriate tool. Insofar as different types of skates require different curvatures, a considerable amount of time is involved in changing from one radius of curvature to another and a good deal of the wheel is wasted in the process. Further, conventional skate sharpening equipment tends to produce non-uniform results and different operators using the same equipment often produce different results.

Accordingly, it is an object of the present invention to provide a new and improved apparatus for sharpening skates to a smooth, sharp edge with a desired hollow ground radius quickly and consistently. Another object of this invention is to provide an apparatus adapted to produce a high quality cutting edge on skates by unskilled operators. Still another object of this invention is to provide a skate sharpening apparatus having a changeable head by means of which the apparatus may be changed quickly and easily to grind skates to different curvatures.

SUMMARY OF THE INVENTION

This invention features an apparatus for sharpening the edges of ice skating blades, or the like, comprising a housing having a guideway, a carriage mounted for movement along said guideway, a clamping bracket mounted on said carriage adapted to clamp the skate in grinding position, a continuous grinding belt mounted to said housing adjacent the path of travel of said carriage, whereby the blade edge may be brought to bear against the belt for grinding and sharpening. A changeable head is mounted at the grinding station behind said belt and in contact with the rear face thereof. The head is formed with several faces each with a different curvature with individual faces selectively engaging the belt to shape the belt into the curvature desired to be ground on the skate, whereby a variety of different skates may be ground to different curvatures using the same belt.

DETAILED DESCRIPTION OF THE PREFERRED EMBODIMENT

Figure 1:
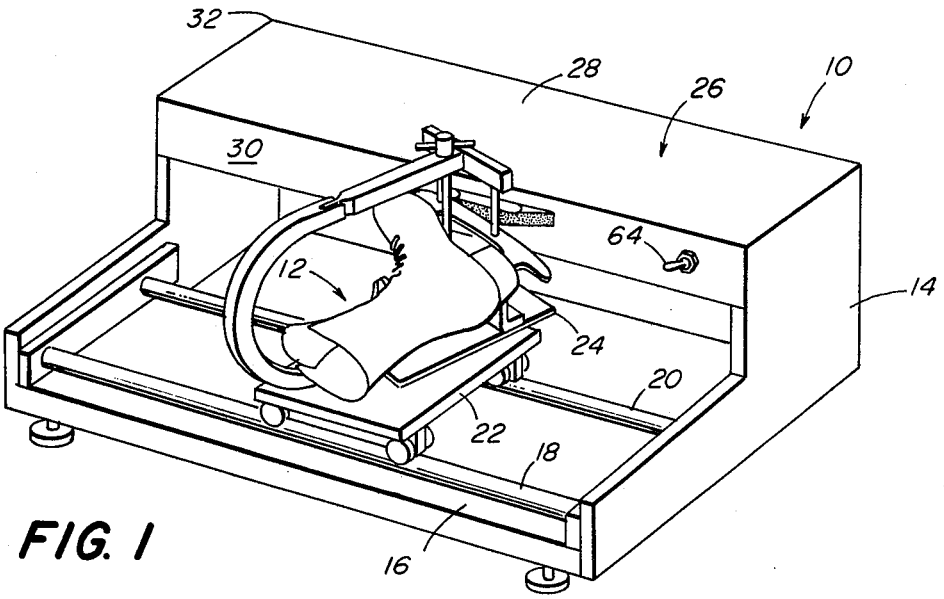
FIG. 1 is a view in perspective of a skate sharpening apparatus made according to the invention.

Referring now to the drawings, the reference character 10 generally indicates an apparatus for sharpening an ice skate 12 to a uniformly consistent high quality edge and to any one of a wide variety of hollow ground curvatures. The apparatus 10 is generally organized about a housing 14 formed with a forwardly extending lower bed 16 having a pair of parallel horizontally extending cylindrical rails 18 and 20 forming a guideway thereon across the front of the housing. The guideway supports a carriage 22 horizontally moveable back and forth across the front of the apparatus and supporting a slideable clamping assembly 24 to which is clamped the skate 12. At the rear of the housing is an upright portion normally enclosed by a hinged cover 26 having a horizontal panel 28 and a downwardly extending front panel 30, the cover being connected to the rear of the housing by means of a hinge 32.

The rear portion of the housing and the cover substantially enclose a power driven belt grinding system comprised of a pair of relatively large pulleys 34 and 36, a head assembly 38, including a pair of relatively small pulleys 40 and 42 and a belt 44 looped about all of the pulleys 34, 36, 40 and 42. The pulley 34 is power driven by means of a motor and the pulley 36 is rotatably mounted to an arm 46 pivoted at 48 to a horizontal wall 50 forming part of the housing. The arm 46 is urged in a normally counter-clockwise direction by means of a coil spring 52 attached to the wall 50 at 54 and to the rear end of the arm 46, thereby applying a counter-clockwise force to the arm about the pivot 48 and applying a tension to the belt 44 looped over the pulley 36. The rear portion of the arm 46 is formed with an arcuate slot 56 through which extends a bolt 58 fixed to the wall 50 and engaging a wing nut 60 threaded thereto. In this fashion the arm may be locked in position yet readily freed up by loosening the wing nut. Whenever it is necessary to change the belt 44, the wing nut 60 is loosened and the arm 46 biased clockwise, thereby moving the pulley 36 to the left and releasing tension on the belt. The belt may then be removed and a fresh one installed. Once the new belt is in place the arm 46 is released and the spring 52 will apply the proper tension to the belt through the arm 46. The wing nut is then again tightened to clamp the arm in position.

Figure 3:
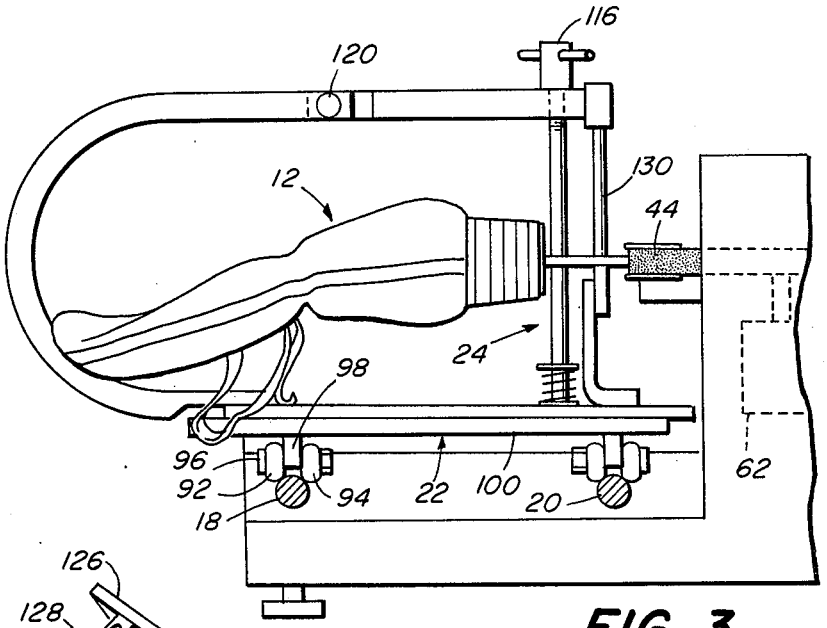
FIG. 3 is a view in side elevation of the apparatus.

The pulley 34 is driven by means of a motor 62 (FIG. 3) mounted below the wall 50 and directly connected to the pulley 34. The motor 62, in turn, is operated by means of a switch 64 which may be conveniently mounted on the front panel 30 of the cover 26 or at any other suitable location. In practice, a gravity type switch (not shown) may be mounted within the cover 26 and in the motor starting circuit so that the motor will automatically shut off whenever the cover is opened, thereby protecting the operator from possible injury. The belt 44 employed in the device is flexible and covered on its outer face with an abrasive grit material adapted to sharpen and/or grind the blade of the skate when the belt is moving at a high speed and the skate is brought into position. Various grits are available, and on belts of this type, for skates that are particulary worn or nicked, a rather heavy grit may be used, whereas for normal sharpening of a blade in otherwise good condition, a relatively fine grit belt would be used.

The head assembly 38 is mounted on the forward edge of the wall 50, generally midway between the pulleys 34 and 36 overhanging, to some extent, the front edge of the wall 50. The head assembly 38 is organized about a rectangular block 64 mounted as by screws 66 to the wall 50. The block 64 is formed with a generally square cutaway portion in its upper forward face to form a transverse shoulder 68 and opposing side shoulders 70 and 72 defining a recess. Mounted in the recess is a plate 74 extending forwardly in a horizontal plane between the pulleys 40 and 42 located at the forward corners of the block 64. The plate 74 is square in outline and formed with a cruciform slot 76 in the center thereof. The plate is clamped into position within the shoulders 68, 70 and 72 by means of a wing nut 78 threaded to a bolt 80 fixed to the block 64 and extending vertically upwards therefrom. In this fashion, a plate may be separated from the block when its position is to be changed.

The plate 38, in the illustrated embodiment, is formed with four different operating edges 82, 84, 86 and 88. Each edge has a distinct radius of curvature adapted to impart a corresponding curvature in the belt 44 which rides along the plate edge. In practice, the radius of curvature of one edge will be ½ inch, 1 inch for the second edge, 3½ inches for the third edge, and a 6 inch radius of curvature for the fourth edge. The radius of curvature of each edge is slightly off-center with respect to the thickness of the plate and, in practice, the radii of each edge is 0.008 inch off-center. The curvature is located off-center for the reason that the blades of skates are of different thicknesses according to the type of skate involved. For example, the blade of a hockey skate normally is ⅛ inch thick while the blades for figure skates and goalie skates are 5/32 inch thick. Thus, if a skate edge were mounted for grinding on the clamp device, the center line of the blade would be off-center with respect to the curvature of the edge if different blade thicknesses were passed through the machine and no compensation was made for the different thicknesses. By way of example, if a figure skate were ground in one operation and a hockey skate were ground in a different operation, without changing the head plate, the radius of curvature produced in one blade would be along the center line of the blade while it would be off-center on the other blade. However, with the head assembly illustrated, the plate 74 may be turned over so as to bring the center line of curvature of the plate edge into the same plane as the center line of the blade edge.

Also, since different types of skates normally are hollow ground to different radii of curvatures, a different plate edge may be brought into position by merely disconnecting the plate and bringing the proper edge to bear. By way of example, hockey skates and standard ice skates normally are hollow ground with a radius of curvature of ½ inch or 1 inch, while figure skates tend to be more flatly ground and a radius of curvature on the order of 3½ inches or 6 inches normally is preferred. In any event, the single plate may be used to grind all of the standard skates to the desired radius of curvature merely by changing the position of the plate. Since the plate has four edges and may be inverted it effectively provides eight different positions.

In order to provide friction and to ensure that the pulleys 40 and 42 at the corner of the block 64 rotate, frictional O-rings 90 are mounted in the center of each pulley.

The skate mounting means includes the carriage 22 and a clamping assembly 24. The carriage 22 is supported by four pairs of relatively fat metal rollers 92 and 94 carried on an axle 26 passing through a boss 98 formed at the bottom face of each corner of the carriage. The rollers 92 and 94 ride along the upper portion of each of the rails 18 and 20 in a smooth tracking motion. The rails 18 and 20 may be rotated periodically to a different angular position in the event that they wear so as to form grooves and thereby alter the initial alignment of the apparatus.

The carriage includes a rigid metal plate 100, the upper surface of which is smooth and flat and on which rests the clamping assembly 24. The clamping assembly 24 includes a flat base plate 102, somewhat smaller than the carriage plate 100, and provided near its forward portion with an upright rest 104. The rest 104 includes a fixed lower portion 106 and an adjustable upper portion 108. The upper portion 108 includes an upper straight edge 110 on which the skate blade is placed prior to clamping. The upper portion 104 is fastened by screws and nuts 112, for example, in order to allow the edge 110 to be precisely aligned with respect to the belt 44 and the head plate 74. Mounted behind the rest 104 is an upright post 114 having a threaded upper end adapted to engage with a nut 116.

Figure 4:
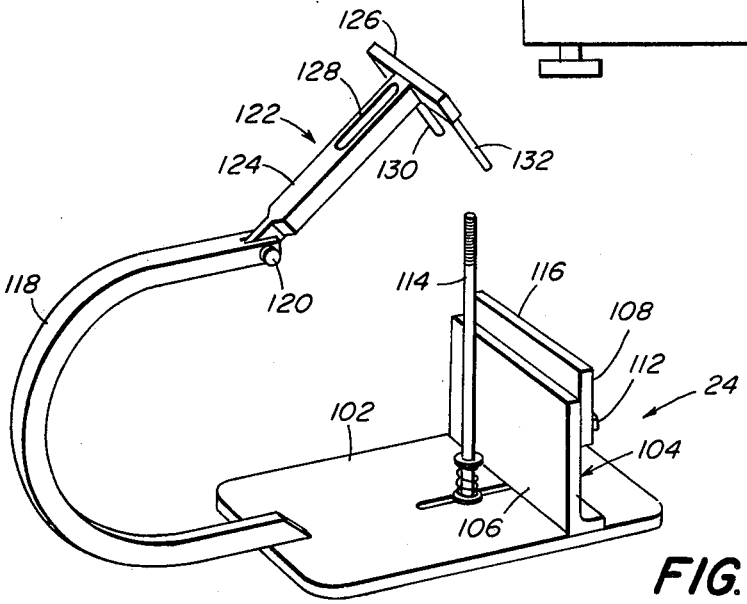
FIG. 4 is a view in perspective of the skate clamp portion of the apparatus.
Figure 6:
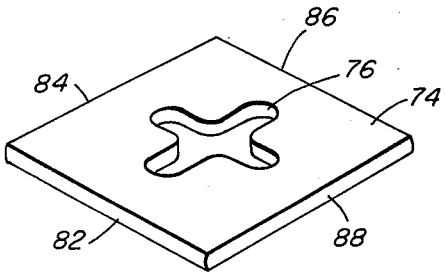
FIG. 6 is a view in perspective of the changeable head plate.
Figure 5:
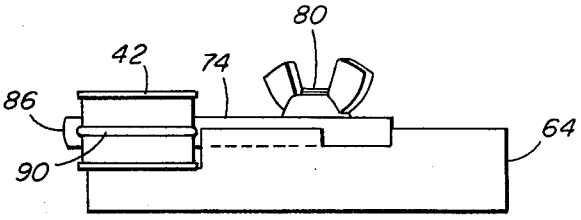
FIG. 5 is a detail view in side elevation of the head assembly.
Figure 2:
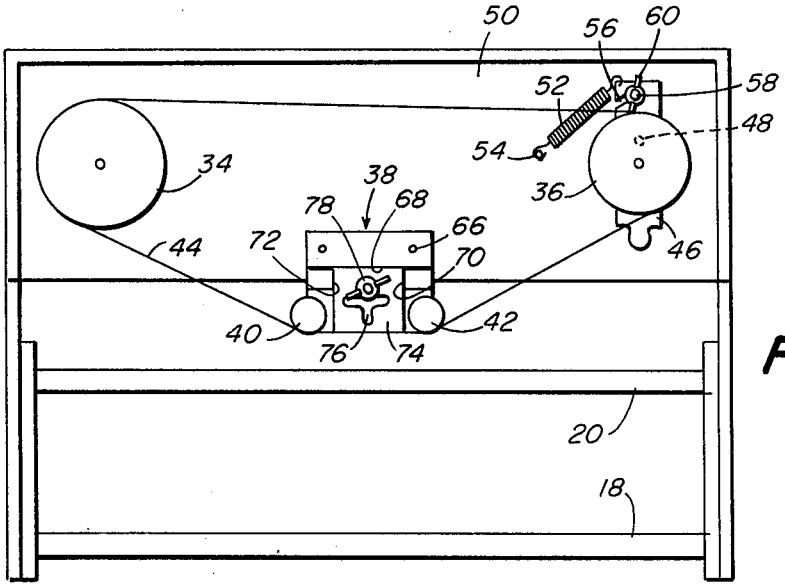
FIG. 2 is a top plan view thereof with the cover removed.
Figure 7:
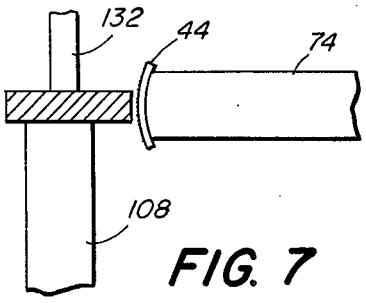
FIGS. 7 and 8 are detailed views in side elevation showing different edges of the head presented for different curvatures.
Figure 8:
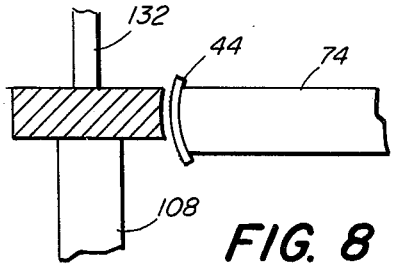

A relatively large U-shaped arm 118 is fixed at its lower end to the base plate 102 and extends rearwardly and upwardly, terminating at its upper end in a hinge 120. At the hinged end of the arm 118 is attached a clamp 122 comprised of a leg 124 at the outer end of which is a crossbar 126. The leg 124 is formed with an elongated slot 128 to receive the upper end of the post 114, while the crossbar 126 is provided with a pair of depending pins 130 and 132. The clamping assembly is used by first opening the clamp to the position shown in FIG. 4. This is done by removing the nut 116 and pivoting the leg 124 upward to the raised position. The skate is then placed within the clamp, the blade edge resting on top of the rest edge 110. The post 114 extends up between the blade and the sole of the skate and, in this position, the clamp is then closed so that the pins 130 and 132 are brought down on the upwardly facing side of the blade so that the blade is clamped on the bottom side of the rest 104 and on the upper side by the pins 130. In this position the nut 116 is then threaded onto the post and tightly secured so as to clamp the skate firmly in position.

With the skate clamped tightly, the motor 62 is started so as to move the belt over the plate edge. The operator then slides the clamping assembly across the top of the carriage, moving the carriage into the appropriate position so as to guide the leading edge of the skate against the moving belt. The operator then feeds the blade smoothly in a steady stroke against the belt in as many passes as necessary to produce a smooth finish. All skate blades will be sharpened to a uniformly high grade finish irrespective of the particular operator using the machine insofar as with the head assembly matched to the blade at the desired curvature, the blade will be sharpened precisely and in a uniform manner.

While the invention has been described with particular reference to the illustrated embodiment, numerous modifications thereto will appear to those skilled in the art. For example, tension may be applied to the belt by means of a separate small spring loaded pulley engaging one reach of the belt. Also, the head assembly may be provided with a plate having a different number of curved edges and the head may be mounted in a different manner so as to bring a different edge into operating position. Further modifications will appear to those skilled in the art.

We claim:

1. Apparatus for sharpening the blade edge of an ice skate or the like with an abrasive belt, comprising a. a support, b. a head mounted to said support, c. belt carrying means mounted to said support for guiding a reach of said belt over said head, d. power means engageable with said belt carrying means for advancing said belt past said head, and, e. skate holding and guide means for mounting said skate for guided movement against said belt at said head, f. said head including a rigid unitary substantially flat plate formed with a plurality of working faces along different peripheral edges thereof selectively engageable with said belt, each of said faces characterized by a different radius of curvature whereby the reach of said belt passing over a selected one of said faces will be curved to a corresponding extent, g. said head including a fixed member for said plate, said plate being formed with at least one opening therethrough and releasable fastening means extending through said opening and connecting to said member for holding said plate in one of several different working positions, h. said skate holding and guide means including a C-shaped clamp and a carriage, said clamp being movably mounted to said carriage and said carriage being movably mounted to said support, i. said clamp including an adjustable blade rest substantially coplanar with said head for supporting a skate blade in position for sharpening engagement with said belt at said head and pivoted arm portion for gripping engagement with said blade opposite said rest.

2. Apparatus, according to claim 1, wherein said support includes a pair of parallel rails movably supporting said carriage.

3. Apparatus, according to claim 1, wherein said belt carrying means includes a plurality of pulleys at least one of which is displaceable with respect to the others.

4. Apparatus, according to claim 3, including an arm pivoted to said support and carrying said one pulley rotatably mounted thereto about an axis displaced from the pivot axis of said arm and spring means biasing said arm about said pivot axis to tension said belt.

* * * * *